US008827117B2

(12) United States Patent
Ho

(10) Patent No.: US 8,827,117 B2
(45) Date of Patent: Sep. 9, 2014

(54) EASILY OPERATED LIQUID DISPENSER

(76) Inventor: Yung-Wei Ho, Chia-Yi (TW)

( * ) Notice: Subject to any disclaimer, the term of this patent is extended or adjusted under 35 U.S.C. 154(b) by 155 days.

(21) Appl. No.: 13/292,307

(22) Filed: Nov. 9, 2011

(65) Prior Publication Data

US 2013/0112714 A1 May 9, 2013

(51) Int. Cl.
*B67D 7/06* (2010.01)
*A47K 5/12* (2006.01)

(52) U.S. Cl.
CPC ..... *A47K 5/1207* (2013.01)
USPC ..... 222/181.3; 222/321.8; 222/325; 222/383.1; 222/517; 222/560

(58) Field of Classification Search
USPC ..... 222/180, 181.1, 181.3, 182, 222/321.6–321.9, 325, 378, 380, 383.1, 222/505–509, 513–514, 517–518, 536, 222/556–561, 379
See application file for complete search history.

(56) References Cited

U.S. PATENT DOCUMENTS 4,120,429 A * 10/1978 Vignot ..... 222/207
4,650,095 A * 3/1987 Tella et al. ..... 222/153.13
5,397,028 A * 3/1995 Jesadanont ..... 222/1
6,315,172 B1 * 11/2001 Till ..... 222/400.7
6,644,516 B1 * 11/2003 Foster et al. ..... 222/190
6,945,431 B2 * 9/2005 Miller ..... 222/144
7,278,554 B2 * 10/2007 Armstrong ..... 222/325
7,389,893 B2 * 6/2008 Kasting ..... 222/321.4
7,658,598 B2 * 2/2010 Reed et al. ..... 417/395
7,798,371 B2 * 9/2010 Ophardt ..... 222/181.3

* cited by examiner

*Primary Examiner* — Paul R Durand
*Assistant Examiner* — Andrew P Bainbridge
(74) *Attorney, Agent, or Firm* — Symbus Law Group, LLC; Clifford D. Hyra

(57) ABSTRACT

A liquid dispenser includes a pressing unit is pivotably connected to a base received in a body. A guiding tube in communication with a container is movably connected to an engagement cap. An inner tube includes a passage in communication with a passage of an outer tube. The inner tube further includes at least one hole in communication with the passage of the inner tube and a passage of the guiding tube. A mouth includes a tube and an end cap having an aperture. The tube includes two rods movably engaged in two sliding grooves of the pressing unit. The tube is coupled to the outer tube, with the aperture of the end cap in communication with the passage of the outer tube. When the pressing unit is pressed, the transverse rods are driven by the sliding grooves to move upward, causing dispensation of a fluid via the aperture.

5 Claims, 5 Drawing Sheets

EASILY OPERATED LIQUID DISPENSER

BACKGROUND OF THE INVENTION

The present invention relates to a liquid dispenser for supplying a fluidic substance such as foams, liquid soaps, detergents, and disinfectants.

Liquid dispensers for dispensing fluidic substances (hereinafter referred to as "fluids"), such as foams, liquid soaps, detergents, and disinfectants, are widely used in houses and business facilities. FIG. 6 shows a conventional liquid dispenser including a body 1', a base 2', and a control unit 3'. The body 1' is a container having a lid 11' that can be removed for supplying the fluid to be dispensed. The base 2' is fixed by fasteners, such as screws, to a bottom of the body 1'. The bottom of the body 1' includes a through-hole 12' in communication with an interior of the body 1' such that the fluid in the body 1' can flow through the through-hole 12' into the base 2'. The base 2' includes a guiding hole 21' in communication with the through-hole 12' of the body 1'. The guiding hole 21' and the through-hole 12' are in a sealed condition such that the fluid can fall into the guiding hole 21'. The lowest portion of the guiding hole 21' is in communication with a connecting tube 22'. An outlet tube 23' extends perpendicularly from a bottom side of the connecting tube 22' and is in communication with an interior of the connecting tube 22'. A valve 24', an elastic element 25', and a piston 26' are mounted in the connecting tube 22'. The piston 26' is fixed to an inner side of a button 27'. An outer side of the button 27' is located outside of the base 2' for manual pressing. The valve 24' can be actuated by the piston 26' to cause opening or closing of a valve port 20' in communication with the connecting tube 22' and the guiding hole 21'. An end of the elastic element 25' abuts a peripheral wall surrounding the valve port 20'. The other end of the elastic element 25' abuts the piston 26'. The elastic element 25' can return the piston 26' after the button 27' is pressed and then released. The piston 26' is in sealing contact with an inner periphery of the connecting tube 22'. The control unit 3' is received in the outlet tube 23' in communication with the connecting tube 22'. The control unit 3' is comprised of a plug 31', an elastic element 32', and a mouth 33'. The plug 31' is in the form of a ball biased by an end of the elastic element 32' such that a valve port 30' of the outlet tube 23' in communication with the connecting tube 22' is normally closed. The valve port 30' is opened when the plug 31' is pressed and disengaged from the valve port 30'. The other end of the elastic element 32' abuts against the mouth 33' fixed in the outlet tube 23'. A seal 34' is provided between the outlet tube 23' and the mouth 33' to prevent leakage of the fluid. In normal condition, the fluid flows to the through-hole 12' and accumulates in the connecting tube 22'. The valve port 30' between the connecting tube 22' and the outlet tube 23' is closed by the plug 31' so that the fluid cannot flow downward. When the button 27' is pressed, the valve 24' is actuated by the piston 26' to close the valve port 20'. The fluid in the connecting tube 22' pushes the plug 31' to move downward and, thus, opens the valve port 30'. The fluid can flow downward through a hole 35' in the mouth 33' and, thus, be dispensed. When the button 27' is released, the returning force of the piston 26' under the action of the elastic element 25' moves the valve 24' to disengage from the valve port 20'. Thus, the valve port 20' is opened and allows the fluid to flow into the connecting tube 22' for next dispensation.

However, the piston 26' and the button 27' are fixed together such that the force applied to the button 27' must be aligned with the longitudinal axis of the piston 26' to avoid the button 27' from being damaged or getting stuck. Although the button 27' is generally provided with an arcuate recess having a center located on the longitudinal axis of the piston 26', not every user is aware of this and applies force along the longitudinal axis of the piston 26' every time. Thus, a need exists for a novel liquid dispenser allowing simple, easy pressing operation to obtain the fluid.

BRIEF SUMMARY OF THE INVENTION

A liquid dispenser according to the present invention includes a body having a compartment. The body further includes a bottom side having an opening. A base is received in the compartment. The base includes a main plate, a left plate extending perpendicularly and downwardly from a bottom of the main plate, a right plate extending perpendicularly and downwardly from the bottom of the main plate, and a back plate extending between rear ends of the left and right plates. Each of the left and right plates includes an axle hole in a front end thereof. The rear plate includes at least one limiting plate and two parallel limiting grooves. The main plate includes a front end having a notch. A wall extends downward from a bottom face of a peripheral wall defining the notch of the main plate.

The liquid dispenser further includes a pressing unit received in the compartment. The pressing unit includes a button extending out of the body via the opening and two parallel elastic elements coupled to the button. The button includes two axles pivotably engaged in the axle holes of the left and right plates of the base. The button further includes a transverse board having a notch located below and aligned with the notch of the main plate. The transverse board further includes two engagement grooves on two sides of the notch of the transverse board. The two elastic elements are received in the two engagement grooves of the transverse board. Parallel, left and right boards extend perpendicularly and downwardly from a bottom face of a peripheral wall defining the notch of the transverse board. Each of the left and right boards includes a bottom face connected to a bottom board. The bottom board includes a notch located below and aligned with the notch of the transverse board. The bottom board further includes two arcuate sliding grooves on two sides of the notch of the bottom board. Each of the two elastic elements has a front end received in one of the engagement grooves and a rear end received in one of the limiting grooves of the rear plate and abutting against a bottom face of the main plate of the base.

The liquid dispenser further includes a nozzle received in the compartment. The nozzle is comprised of a container, a sleeve, a guiding tube, a first spring, an inner tube, an outer tube, an engagement lid, and a mouth. The container includes a fluid inlet in communication with an interior of the container and a fluid outlet tube in communication with the interior of the container. A lid is mounted to the fluid inlet. The sleeve includes an upper opening, a passage in communication with the upper opening, a lower opening in communication with the passage, and an annular lip formed on an outer periphery of the sleeve. The upper opening of the sleeve is located in the notch of the main plate and coupled with the fluid outlet tube. An engagement cap is engaged a lower end of the sleeve having the lower opening. The engagement cap has a through-hole. The annular lip of the sleeve includes an upper face abutting a bottom face of the wall of the main plate.

The guiding tube includes an upper opening, a check valve mounted in a bottom of the upper opening of the guiding tube, a passage in communication with the upper opening of the guiding tube, a lower opening in communication with the passage of the guiding tube, a vent in communication with the passage of the guiding tube, and a fastener engaged with the lower opening of the guiding tube and having a through-hole. The fastener and a lower end of the guiding tube having the lower opening of the guiding tube are movably engaged with engagement cap. The upper opening of the guiding tube extends through the upper opening of the sleeve and is in communication with the interior of the container. A first seal is mounted around an upper end of the guiding tube having the upper opening. The first seal is in sealing contact with an inner periphery of the upper opening of the sleeve.

The inner tube includes a receptacle having an open upper end and a closed lower end. A tubular body extends downward from a bottom face of the closed lower end of the receptacle and includes a passage. The inner tube further includes at least one hole in communication with the passage of the inner tube. The first spring has a lower end abutting the closed lower end of the receptacle and an upper end abutting the check valve in the upper opening of the guiding tube.

The outer tube is received in the passage of the guiding tube. The outer tube includes a fitting having an open upper end. The outer tube further includes a tubular body having at least one stop on an inner periphery of the tubular body of the outer tube. The outer tube further includes a passage extending through the fitting and the tubular body of the outer tube. A piston is movably engaged with the fitting. The piston includes an outer periphery in sealing contact with an inner periphery of the guiding tube. The piston includes an inner periphery in sealing contact with the tubular body of the inner tube. The fitting allows insertion of the tubular body of the inner tube, with a bottom of the tubular body of the inner tube abutting an upper face of the at least one stop of the tubular body of the outer tube. A bottom of the tubular body of the outer tube extends through the through-hole of the fastener of the guiding tube.

The mouth comprised of a tube, a second seal, a plug, a second spring, and an end cap. The end cap extends out of the body via the opening and has an aperture. The tube includes an upper opening and a lower opening. A partitioning plate is mounted in the tube and includes a through-hole in communication with the upper and lower openings of the tube. The tube further includes two transverse rods. The bottom of the tubular body of the outer tube is inserted through the upper opening of the tube. The through-hole of the tube is in communication with the passage of the outer tube. The second seal is mounted around a periphery of the through-hole of the partitioning plate. The plug is biased by an upper end the second spring to press against the second seal for interrupting passage of the fluid. The end cap is mounted to and closing the lower opening of the tube. The second spring has a lower end abutting the end cap. The two transverse rods are movably engaged in the arcuate sliding grooves of the button.

Preferably, the body includes a front housing and a rear housing coupled to the front housing. The compartment is defined between the front and rear housings. The front housing includes the bottom side having the opening.

Preferably, the front housing includes an upper end having an engagement hole. The front housing further includes two lateral inner faces each having a stub that extends towards the compartment and that has circular cross sections. The rear housing includes an upper end having a resilient engaging member. The resilient engaging member of the rear housing is engaged with the engagement hole of the front housing. The rear housing includes two lateral outer faces each having a cylindrical stub hole. The stubs of the front housing are engaged in the stub holes of the rear housing.

Preferably the rear housing further includes an abutment plate extending towards the compartment. Each of the two lateral inner faces of the rear housing has at least one groove having an open upper end and a bottom end closed by an inner face of a bottom side of the rear housing. Each of the left and right plates includes an outer face having a limiting block engaged in the at least one groove of the rear housing. The abutment plate of the rear housing abuts against an upper end of the main plate of the base.

Preferably, a stop is formed between a front end of each of the two arcuate sliding grooves and a front end of the notch of the bottom board and extends towards the notch of the transverse board.

The present invention will become clearer in light of the following detailed description of illustrative embodiments of this invention described in connection with the drawings.

DETAILED DESCRIPTION OF THE INVENTION

Figure 1:
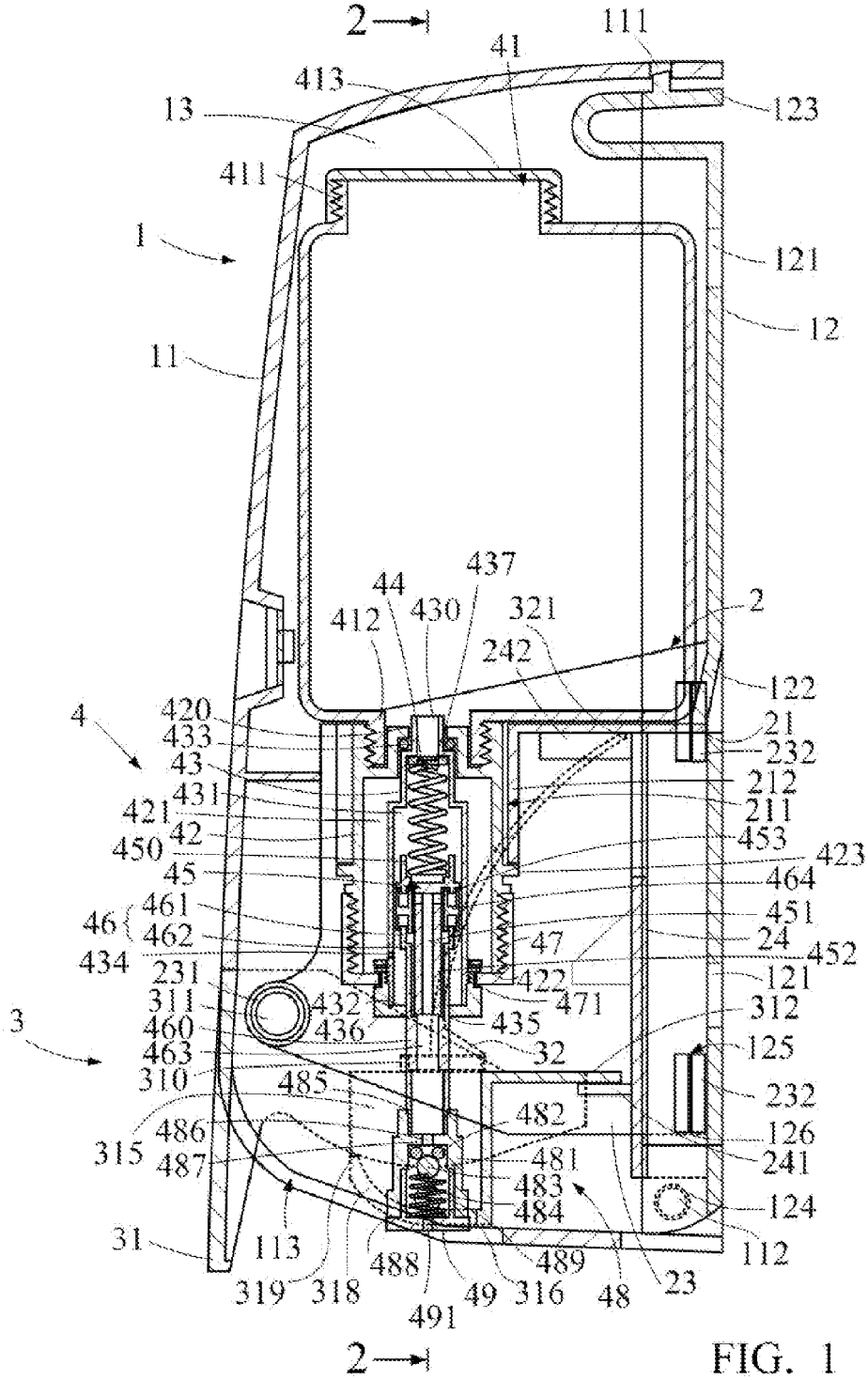
FIG. 1 shows a cross sectional view of a liquid dispenser according to the present invention.
Figure 2:
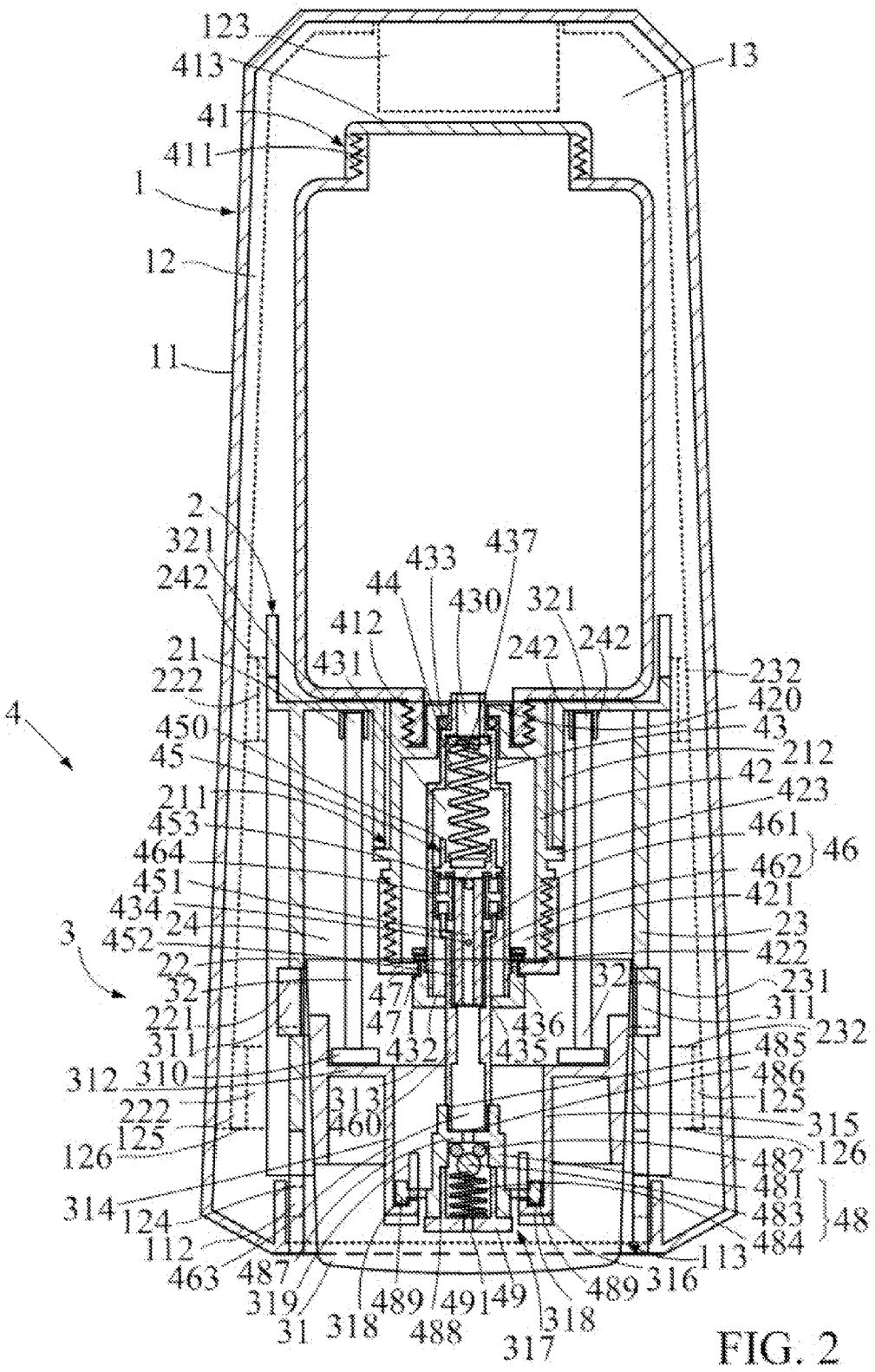
FIG. 2 shows a cross sectional view taken along line 2-2 in FIG. 1.
Figure 3:
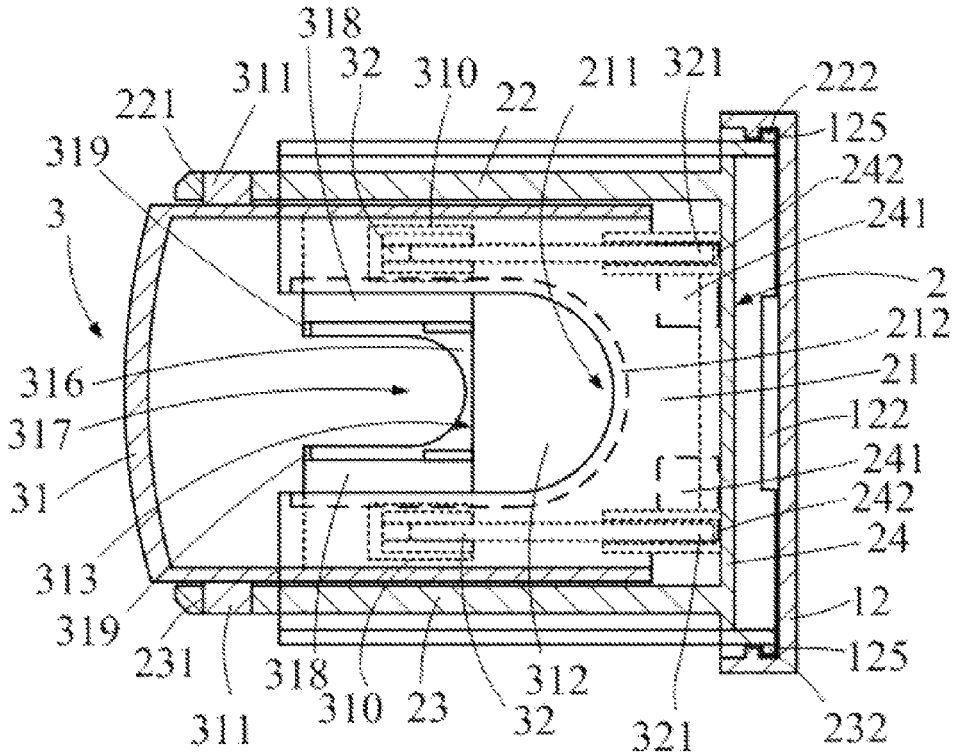
FIG. 3 shows a cross sectional view of a body, a base, and a pressing unit of the liquid dispenser of FIG. 1 after assembly.

With reference to FIGS. 1-3, a liquid dispenser according to the present invention includes a body 1, a base 2, a pressing unit 3, and a nozzle 4.

The body 1 includes a front housing 11 and a rear housing 12 coupled to the front housing 11. A compartment 13 is defined between the front and rear housings 11 and 12 and receives the base 2, the pressing unit 3, and the nozzle 4. The front housing 11 includes an upper end having an engagement hole 111. The front housing 11 further includes two lateral inner faces each having a stub 112 that extends towards the compartment 13 and that has circular cross sections. The front housing 11 further includes a bottom side having an opening 113 through which portions of the pressing unit 3 and the nozzle 4 extends out of the body 1. The rear housing 12 includes a plurality of hanging holes 121 allowing the rear housing 12 to be hung on a nail on a wall or the like. The rear housing 12 further includes an abutment plate 122 extending towards the compartment 13. The rear housing 12 includes an upper end having a resilient engaging member 123. The resilient engaging member 123 of the rear housing 12 is engaged with the engagement hole 111 of the front housing 11. The rear housing 12 further includes two lateral outer faces each having a cylindrical stub hole 124. The stubs 112 of the front housing 11 are engaged in the stub holes 124 of the rear housing 12. Before the resilient engaging member 123 is engaged in the engagement hole 111, the front housing 11 can pivot relative to the rear housing 11 while the stubs 112 pivot in the stub holes 124. Each lateral inner face of the rear housing 12 includes at least one groove 125 having an open upper end and a bottom end closed by an inner face of a bottom side of the rear housing 12.

The base 2 includes a main plate 21, a left plate 22 extending perpendicularly and downwardly from a bottom of the main plate 21, a right plate 23 extending perpendicularly and downwardly from the bottom of the main plate 21, and a back plate 24 extending between rear ends of the left and right plates 22 and 23. Each of the left and right plates 22 and 23 includes an axle hole 221, 231 in a front end thereof. Each of the left and right plates 22 and 23 includes an outer face having a limiting block 222, 232 for engagement with one of the grooves 125 of the rear housing 12. Specifically, the sliding blocks 222 and 232 are slid into and engaged with the grooves 125 on the lateral inner faces of the rear housing 12, with the abutment plate 122 abutting against an upper end of the main plate 21 of the base 2, securely engaging the base 2 with the rear housing 12. The rear plate 24 includes at least one limiting plate 241 and two parallel limiting grooves 242. The main plate 21 includes a front end having a notch 211. A wall 212 extends downward from a bottom face of a peripheral wall defining the notch 211 of the main plate 21.

The pressing unit 3 includes a button 31 and extending out of the body 1 via the opening 113 and two parallel elastic elements 32 coupled to the button 31 for returning the button 31 after the button 31 is pressed and released. The button 31 includes two axles 311 pivotably engaged in the axle holes 221 and 231 of the left and right plates 22 and 23 of the base 2, such that the button 31 can pivot about a pivot axis defined by the axles 311 received in the axle holes 221 and 231. The button 31 further includes a transverse board 312 having a notch 313 located below and aligned with the notch 211 of the main plate 21. The transverse board 312 further includes two engagement grooves 310 on two sides of the notch 313 of the transverse board 312. The elastic elements 32 are received in the engagement grooves 310 of the transverse board 312. Parallel, left and right boards 314 and 315 extend perpendicularly and downwardly from a bottom face of a peripheral wall defining the notch 313 of the transverse board 312. Each of the left and right boards 314 and 315 includes a bottom face connected to a bottom board 316. The bottom board 316 includes a notch 317 located below and aligned with the notch 313 of the transverse board 312. The bottom board 316 further includes two arcuate sliding grooves 318 on two sides of the notch 317 of the bottom board 316. Preferably, a stop 319 is formed between a front end of each arcuate sliding groove 318 and a front end of the notch 317 of the bottom board 316 and extends towards the notch 313 of the transverse board 312. Each elastic element 32 has a front end received in one of the engagement grooves 310. Each elastic element 32 has a rear end 321 received in one of the limiting grooves 242 of the rear plate 24 and abutting against a bottom face of the main plate 21. After a pressing force acting on the button 31 coupled to the elastic elements 32 vanishes, the transverse board 312 of the button 31 abuts against the at least one limiting plate 241 of the back plate 24 to stop pivotal movement of the button 31.

The nozzle 4 is comprised of a container 41, a sleeve 42, a guiding tube 43, a first spring 44, an inner tube 45, an outer tube 46, an engagement lid 47, and a mouth 48. The container 41 includes a fluid inlet 411 in communication with an interior of the container 41 and a fluid outlet tube 412 in communication with the interior of the container 41. A lid 413 is mounted to the container 41 to cover the fluid inlet 411. The lid 413 can be removed from the container 41 to allow supply of the fluid into the container 41 via the fluid inlet 411.

The sleeve 42 includes an upper opening 420, a passage 421 in communication with the upper opening 420, a lower opening 422 in communication with the passage 421, and an annular lip 423 formed on an outer periphery of the sleeve 42. The upper opening 420 of the sleeve 42 is located in the notch 211 of the main plate 21 and coupled with the fluid outlet tube 412 by threading connection. An engagement cap 47 is threadedly engaged with a lower end of the sleeve 42 having the lower opening 422 and includes a through-hole 471. The annular lip 423 of the sleeve 42 has an upper face abutting a bottom face of the wall 212 of the main plate 21.

The guiding tube 43 includes an upper opening 430, a check valve 437 mounted in a bottom of the upper opening 430 for preventing reverse flow of the fluid, a passage 431 in communication with the upper opening 430 of the guiding tube 43, a lower opening 432 in communication with the passage 431 of the guiding tube 43, a vent 434 in communication with the passage 431 of the guiding tube 43, and a fastener 436 engaged with the lower opening 432 of the guiding tube 43 and having a through-hole 435. The fastener 436 and a lower end of the guiding tube 43 having the lower opening 432 are movably engaged with engagement cap 47. The upper opening 430 of the guiding tube 43 extending through the upper opening 420 of the sleeve 42 and is in communication with the interior of the container 41, such that the fluid in the container 41 can flow through the upper opening 430 into the guiding tube 43. To prevent the fluid from flowing through a space between an upper end of the sleeve 42 having the upper opening 420 and an upper end of the guiding tube 43 having the upper opening 430, a first seal 433 is mounted around the upper end of the guiding tube 43 and is in sealing contact with an inner periphery of the upper opening 420 of the sleeve 42.

The inner tube 45 includes a receptacle 450 having an open upper end and a closed lower end. A tubular body 452 extends downward from a bottom face of the closed lower end of the receptacle 450 and includes a passage 451. The inner tube 45 further includes at least one hole 453 in communication with the passage 451 of the inner tube 45 and the passage 431 of the guiding tube 43. The first spring 44 has a lower end abutting the closed lower end of the receptacle 450 and an upper end abutting the check valve 437 in the upper opening 430 of the guiding tube 43. Thus, the inner tube 45 can return to its initial position after the pressing force vanishes.

The outer tube 46 is received in the passage 431 of the guiding tube 43. The outer tube 46 includes a fitting 461 having an open upper end. The outer tube 46 further includes a tubular body 462 having at least one stop 460 on an inner periphery of the tubular body 462. The outer tube 46 further includes a passage 463 extending through the fitting 461 and the tubular body 462 of the outer tube 46. A piston 464 is movably engaged with the fitting 461. The piston 464 includes an outer periphery in sealing contact with an inner periphery of the guiding tube 43. The piston 464 includes an inner periphery in sealing contact with the tubular body 452 of the inner tube 45. The fitting 462 allows insertion of the tubular body 452 of the inner tube 45, with a bottom of the tubular body 452 of the inner tube 45 abutting an upper face of the at least one stop 460 of the tubular body 462 of the outer tube 46, such that the passage 451 of the inner tube 45 is in communication with the passage 463 of the outer tube 46. A bottom of the tubular body 462 of the outer tube 46 extends through the through-hole 435 of the fastener 436 of the guiding tube 43.

The mouth 48 is comprised of a tube 481, a second seal 482, a plug 483 such as a ball, a second spring 484, and an end cap 49 having an aperture 491. The tube 481 includes an upper opening 485 and a lower opening 488. A partitioning plate 487 is mounted in the tube 481 and includes a through-hole 486 in communication with the upper and lower openings 485 and 488 of the tube 481. The tube 481 further includes two transverse rods 489. The bottom of the tubular body 462 of the outer tube 46 is inserted through the upper opening 485 of the tube 481, with the through-hole 486 of the tube 481 in communication with the passage 463 of the outer tube 46. The second seal 482 and the second spring 484 are mounted into the lower opening 488 in sequence. The second seal 482 is mounted around a periphery of the through-hole 486 of the partitioning plate 487. The plug 483 is biased by an upper end the second spring 484 to press against the second seal 483 for interrupting passage of the fluid. The end cap 49 is mounted to and closes the lower opening 488 of the tube 481. The second spring 484 has a lower end abutting the end cap 49. Thus, the plug 483 can be returned to its initial position after the pressing force vanishes. The transverse rods 489 are movably engaged in the arcuate sliding grooves 318 of the button 31.

Figure 4:
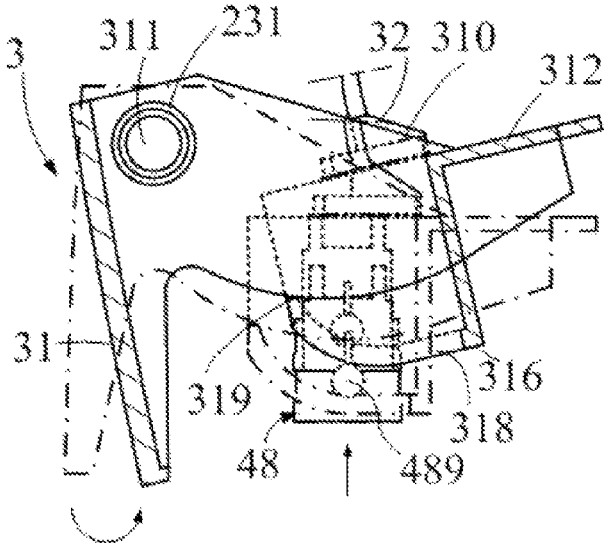
FIG. 4 shows a cross sectional view illustrating operation of the pressing unit.
Figure 5:
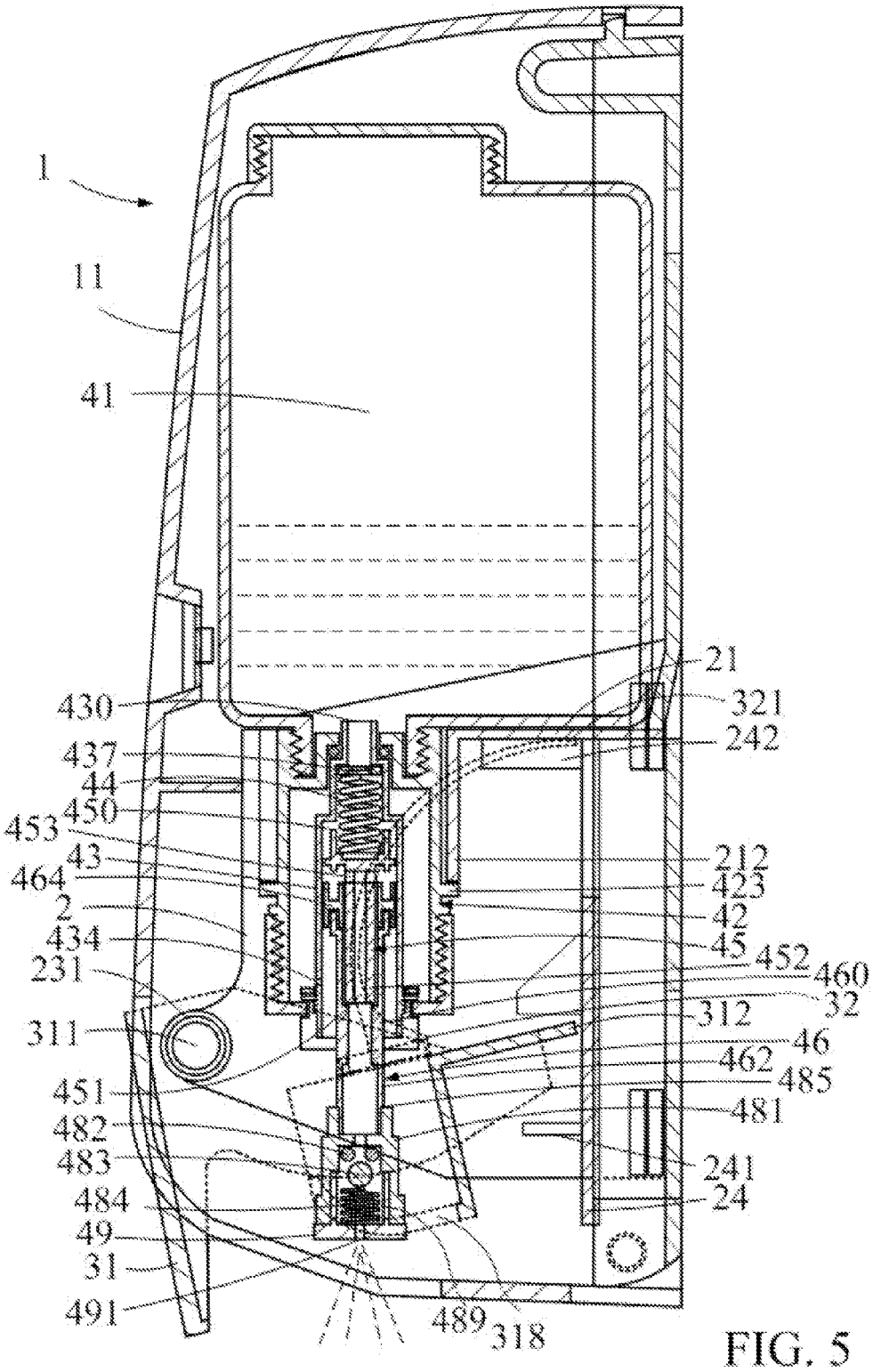
FIG. 5 shows a cross sectional view illustrating use of the liquid dispenser according to the present invention.
Figure 6:
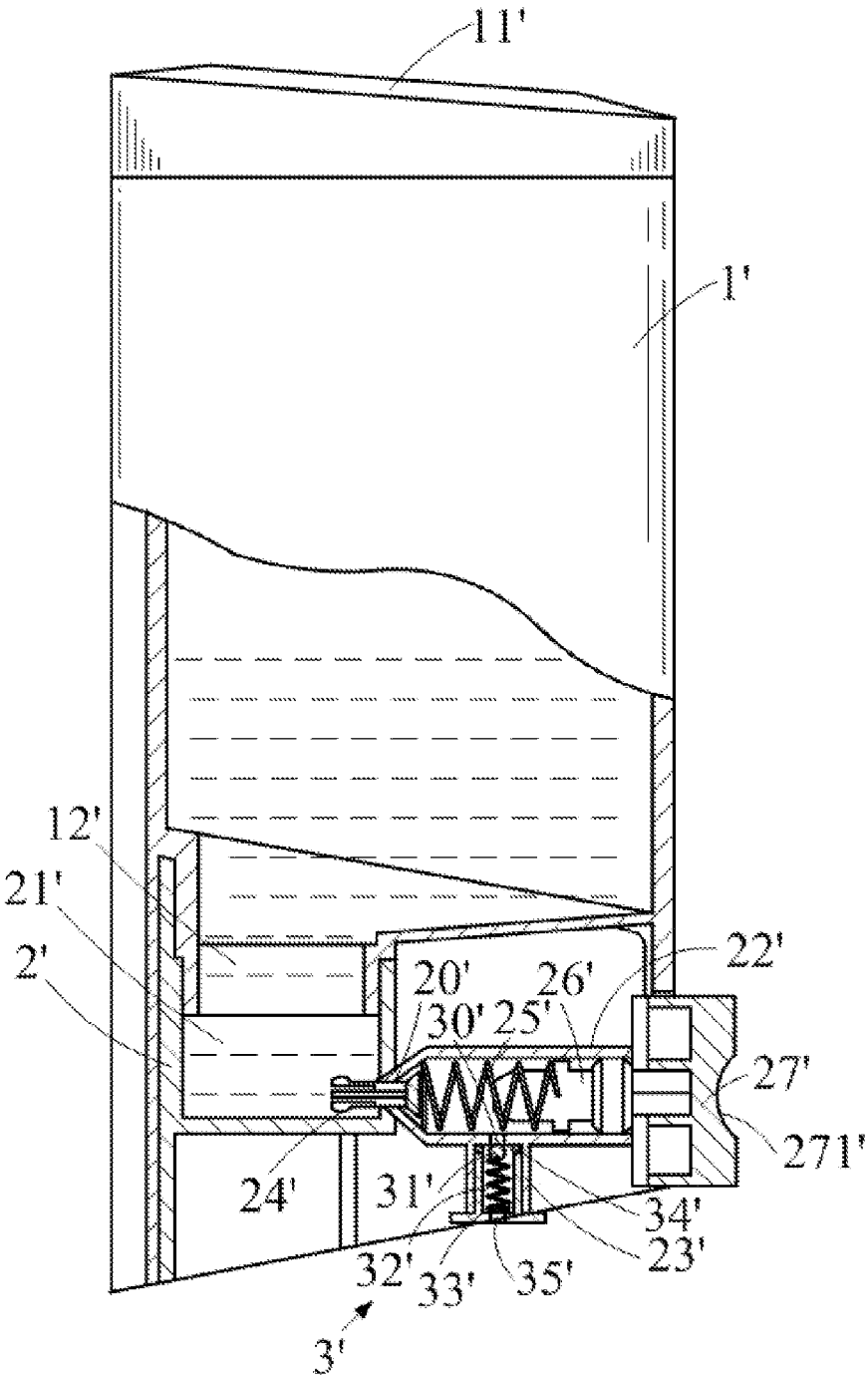
FIG. 6 PRIOR ART
FIG. 6 shows a partial, cross sectional view of a conventional liquid dispenser.

With reference to FIGS. 4 and 5, when button 31 is pressed, the button 31 can pivot about the pivot axis defined by the axles 311 in the axle holes 221 and 231 of the base 2. Since the upper face of the annular lip 423 abuts the bottom face of the wall 212 of the main plate 21, the sleeve 42 can not move. The transverse rods 489 of the tube 481 are driven by the arcuate sliding grooves 318 of the button 31 and move upwards, causing upward movement of the tubular body 462 of the outer tube 46 received in the upper opening 485 of the tube 481. Since the bottom of the tubular body 452 of the inner tube 45 abuts the upper face of the stop 460 of the tubular body 462 of the outer tube 46 and due to provision of the vent 434, the inner tube 45 also moves upward. Since the lower end of the first spring 44 abuts the lower end of the receptacle 450 and since the upper end of the first spring 44 abuts the check valve 437, the first spring 44 is compressed. At the same time, the check valve 437 closes the upper opening 430 of the guiding tube 43. Due to the sealing contact between the piston 464 and the inner periphery of the guiding tube 43, the fluid accumulated in the guiding tube 43 pushes the piston 464 out of the hole 453 of the inner tube 45. At the same time, the fluid stopped by the piston 464 flows through the hole 453 of the inner tube 45 into the passage 451 of the inner tube 45. The fluid in the passage 451 of the inner tube 45 forces the plug 483 to disengage from the second seal 482, such that the fluid passes through the second seal 482 and is dispensed via the aperture 491 of the end cap 49. Furthermore, since the rear ends 321 of the springs 32 coupled to the button 31 are received in the limiting grooves 242 and abut the bottom face of the main plate 21, the springs 32 are compressed when the button 31 is pressed. When the pressing force on the button 31 vanishes, the returning force of the springs 32 pivot the button 31 in the reverse direction until the transverse board 312 abuts against the at least one limiting plate 241 of the back plate 241, as shown in FIG. 1. At the same time, the returning force of the compressed first spring 44 pushes the inner tube 45 and the outer tube 46 to move downward. The inner periphery of the piston 464 closes the hole 453 of the inner tube 45 such that the fluid can not flow out through the hole 453 of the inner tube 45. Thus, the plug 483 is not pressed by the fluid and is biased by the second spring 484 to press against the second seal 482. Accordingly, the fluid will not flow out of the body 1.

In brief, since the transverse rods 489 of the mouth 48 are movably engaged in the arcuate sliding grooves 318 of the button 31, the arcuate sliding grooves 318 can drive and guide the transverse rods 489 to move upward when the button 31 is pressed, causing the fluid to flow through the second seal 482 and to be dispensed via the aperture 491 of the end cap 49. The operation is simple and easy.

Although specific embodiments have been illustrated and described, numerous modifications and variations are still possible without departing from the essence of the invention. The scope of the invention is limited by the accompanying claims.

The invention claimed is:

1. A liquid dispenser comprising:

a body including a compartment, with the body further including a bottom side having an opening;

a base received in the compartment, with the base including a main plate, a left plate extending perpendicularly and downwardly from a bottom of the main plate, a right plate extending perpendicularly and downwardly from the bottom of the main plate, and a back plate extending between rear ends of the left and right plates, with each of the left and right plates including an axle hole in a front end thereof, with the rear plate including at least one limiting plate and two parallel limiting grooves, with the main plate including a front end having a notch, with a wall extending downward from a bottom face of a peripheral wall defining the notch of the main plate;

a pressing unit received in the compartment, with the pressing unit including a button extending out of the body via the opening and two parallel elastic elements coupled to the button, with the button including two axles pivotably engaged in the axle holes of the left and right plates of the base, with the button further including a transverse board having a notch located below and aligned with the notch of the main plate, with the transverse board further including two engagement grooves on two sides of the notch of the transverse board, with the two elastic elements received in the two engagement grooves of the transverse board, with parallel, left and right boards extending perpendicularly and downwardly from a bottom face of a peripheral wall defining the notch of the transverse board, with each of the left and right boards including a bottom face connected to a bottom board, with the bottom board including a notch located below and aligned with the notch of the transverse board, with the bottom board further including two arcuate sliding grooves on two sides of the notch of the bottom board, with each of the two elastic elements having a front end received in one of the engagement grooves, with each of the two elastic elements having a rear end received in one of the limiting grooves of the rear plate and abutting against a bottom face of the main plate of the base;

a nozzle received in the compartment, with the nozzle comprised of a container, a sleeve, a guiding tube, a first spring, an inner tube, an outer tube, an engagement lid, and a mouth, with the container including a fluid inlet in communication with an interior of the container and a fluid outlet tube in communication with the interior of the container, with a lid mounted to the fluid inlet, with the sleeve including an upper opening, a passage in communication with the upper opening, a lower opening in communication with the passage, and an annular lip formed on an outer periphery of the sleeve, with the upper opening of the sleeve located in the notch of the main plate and coupled with the fluid outlet tube, with an engagement cap engaged a lower end of the sleeve having the lower opening, with the engagement cap having a through-hole, with the annular lip of the sleeve including an upper face abutting a bottom face of the wall of the main plate, with the guiding tube including an upper opening, a check valve mounted in a bottom of the upper opening of the guiding tube, a passage in communication with the upper opening of the guiding tube, a lower opening in communication with the passage of the guiding tube, a vent in communication with the passage of the guiding tube, and a fastener engaged with the lower opening of the guiding tube and having a through-hole, with the fastener and a lower end of the guiding tube having the lower opening of the guiding tube movably engaged with engagement cap, with the upper opening of the guiding tube extending through the upper opening of the sleeve and being in communication with the interior of the container, with a first seal mounted around an upper end of the guiding tube having the upper opening, with the first seal in sealing contact with an inner periphery of the upper opening of the sleeve, with the inner tube including a receptacle having an open upper end and a closed lower end, with a tubular body extending downward from a bottom face of the closed lower end of the receptacle and including a passage, with the inner tube further including at least one hole in communication with the passage of the inner tube, with the first spring having a lower end abutting the closed lower end of the receptacle and an upper end abutting the check valve in the upper opening of the guiding tube, with the outer tube received in the passage of the guiding tube, with the outer tube including a fitting having an open upper end, with the outer tube further including a tubular body having at least one stop on an inner periphery of the tubular body of the outer tube, with the outer tube further including a passage extending through the fitting and the tubular body of the outer tube, with a piston movably engaged with the fitting, with the piston including an outer periphery in sealing contact with an inner periphery of the guiding tube, with the piston including an inner periphery in sealing contact with the tubular body of the inner tube, with the fitting allowing insertion of the tubular body of the inner tube, with a bottom of the tubular body of the inner tube abutting an upper face of the at least one stop of the tubular body of the outer tube, with a bottom of the tubular body of the outer tube extending through the through-hole of the fastener of the guiding tube, with the mouth comprised of a tube, a second seal, a plug, a second spring, and an end cap, with the end cap extending out of the body via the opening and having an aperture, with the tube including an upper opening and a lower opening, with a partitioning plate mounted in the tube and including a through-hole in communication with the upper and lower openings of the tube, with the tube further including two transverse rods, with the bottom of the tubular body of the outer tube inserted through the upper opening of the tube, with the through-hole of the tube in communication with the passage of the outer tube, with the second seal mounted around a periphery of the throughhole of the partitioning plate, with the plug biased by an upper end the second spring to press against the second seal for interrupting passage of the fluid, with the end cap mounted to and closing the lower opening of the tube, with the second spring having a lower end abutting the end cap, with the two transverse rods movably engaged in the two arcuate sliding grooves of the button.

2. The liquid dispenser as claimed in claim 1, with the body including a front housing and a rear housing coupled to the front housing, with the compartment defined between the front and rear housings, with the front housing including the bottom side having the opening.

3. The liquid dispenser as claimed in claim 2, with the front housing including an upper end having an engagement hole, with the front housing further including two lateral inner faces each having a stub that extends towards the compartment and that has circular cross sections, with the rear housing including an upper end having a resilient engaging member, with the resilient engaging member of the rear housing engaged with the engagement hole of the front housing, with the rear housing including two lateral outer faces each having a cylindrical stub hole, with the stubs of the front housing engaged in the stub holes of the rear housing.

4. The liquid dispenser as claimed in claim 3, with the rear housing further including an abutment plate extending towards the compartment, with each of the two lateral inner faces of the rear housing having at least one groove, with the at least one groove including an open upper end and a bottom end closed by an inner face of a bottom side of the rear housing, with each of the left and right plates including an outer face having a limiting block engaged in the at least one groove of the rear housing, with the abutment plate of the rear housing abutting against an upper end of the main plate of the base.

5. The liquid dispenser as claimed in claim 4, with a stop formed between a front end of each of the two arcuate sliding grooves and a front end of the notch of the bottom board and extending towards the notch of the transverse board.

* * * * *